US007663457B2

(12) United States Patent
Szeifert et al.

(10) Patent No.: US 7,663,457 B2
(45) Date of Patent: Feb. 16, 2010

(54) MAGNETIC LATCH FOR A VOICE COIL ACTUATOR

(75) Inventors: Bela Peter Szeifert, Cedar Grove, WI (US); Michael Peter Dunk, Caledonia, WI (US)

(73) Assignee: Cooper Technologies Company, Houston, TX (US)

( * ) Notice: Subject to any disclaimer, the term of this patent is extended or adjusted under 35 U.S.C. 154(b) by 315 days.

(21) Appl. No.: 11/755,997

(22) Filed: May 31, 2007

(65) Prior Publication Data

US 2008/0297986 A1 Dec. 4, 2008

(51) Int. Cl.
*H01H 9/00* (2006.01)

(52) U.S. Cl. ..... 335/179; 335/2; 335/6; 335/38; 335/41; 335/63; 335/121; 335/126; 335/151; 335/170; 335/174; 335/180; 335/185; 335/187; 335/195; 335/196; 335/201; 335/255; 218/22; 218/118; 218/140; 218/154; 361/45; 361/79; 361/97; 361/98; 361/115; 200/277; 200/144 R; 307/117; 307/139; 307/132 R; 307/125; 310/12; 310/90.5; 318/115; 318/135; 324/76.58; 324/500; 341/123

(58) Field of Classification Search ..... 218/22–28, 218/118, 140, 154; 361/45, 98, 97, 79, 115, 361/135; 200/277, 144 R; 335/2, 6, 38, 335/63, 41, 121, 126, 151, 170, 174, 179–180, 335/185, 187, 195–196, 201, 255; 307/117, 307/139, 132 R, 125; 310/12, 90.5; 318/115, 318/135; 324/76.58, 500; 341/123; 720/663–666
See application file for complete search history.

(56) References Cited

U.S. PATENT DOCUMENTS

| | | | | |
|---|---|---|---|---|
| 3,086,094 | A | 4/1963 | Ovshinsky | |
| 3,984,706 | A * | 10/1976 | Inouye | 310/12 |
| 4,305,105 | A * | 12/1981 | Ho et al. | 360/266.8 |
| 4,661,729 | A * | 4/1987 | Hames et al. | 310/13 |
| 4,868,432 | A * | 9/1989 | Frandsen | 310/12 |
| 5,387,892 | A | 2/1995 | Rossetti et al. | |
| 5,389,845 | A | 2/1995 | Brimhall | |
| 5,434,458 | A * | 7/1995 | Stuart et al. | 310/13 |
| 6,194,796 | B1 * | 2/2001 | Yeakley | 310/14 |
| 6,291,911 | B1 | 9/2001 | Dunk et al. | |

(Continued)

FOREIGN PATENT DOCUMENTS

JP 61244255 A * 10/1986

*Primary Examiner*—Elvin G Enad
*Assistant Examiner*—Mohamad A Musleh
(74) *Attorney, Agent, or Firm*—King & Spalding LLP

(57) ABSTRACT

Magnetically latching and releasing a voice coil actuator for controlling electrical switchgear. The voice coil actuator includes a voice coil magnet disposed on a common longitudinal axis with respect to a voice coil assembly. A coil of the voice coil assembly exerts a magnetic force on the voice coil assembly, thrusting the voice coil assembly towards the voice coil magnet. At least one pair of latching members mounted to the voice coil assembly creates a permanent magnet circuit between the latching members and the voice coil magnet. The permanent magnet circuit maintains the position of the voice coil assembly relative to the voice coil magnet, even when power to the coil is removed. This latch can be released by applying a current in the coil or by applying an external, physical force to a member coupled to the voice coil assembly.

38 Claims, 9 Drawing Sheets

U.S. PATENT DOCUMENTS 6,331,687 B1 12/2001 Dunk et al.
6,538,347 B1 3/2003 Baranowski et al.
6,756,751 B2 * 6/2004 Hunter ..... 318/135
6,921,989 B2 7/2005 Baranowski et al.
2003/0062978 A1 * 4/2003 Shiraki et al. ..... 335/151
2003/0071522 A1 * 4/2003 Baranowski et al. ..... 307/116
2005/0012920 A1 * 1/2005 Jeanne et al. ..... 355/72

* cited by examiner

MAGNETIC LATCH FOR A VOICE COIL ACTUATOR

TECHNICAL FIELD

The invention relates generally to a method and device for controlling electrical switchgear. More specifically, the invention relates to a method and device for magnetically latching and releasing a voice coil actuator for controlling electrical switchgear.

BACKGROUND OF THE INVENTION

In a power distribution system, electrical switchgear are typically employed to protect the system against abnormal conditions, such as power line fault conditions or irregular loading conditions. There are different types of switchgear for different applications. A first type of switchgear is a fault interrupter. Fault interrupters are configured to automatically open a power line upon the detection of a fault condition.

A second type of switchgear is a recloser. Reclosers are configured to respond to a fault condition by rapidly tripping open and then reclosing a power line a number of times, in accordance with a set of time-current curves. After a predetermined number of trip/reclose operations, the recloser will "lock-out" the power line, if the fault condition has not been cleared.

A breaker is a third type of switchgear. Breakers are similar to reclosers. However, they are generally capable of performing only a single open-close-open sequence, and the currents at which they interrupt current flow are significantly higher than those of reclosers.

A capacitor switch is a fourth type of switchgear. Capacitor switches are used for energizing and de-energizing capacitor banks. Capacitor banks are used for regulating the line current feeding a large load (e.g., an industrial load) when the load causes the line current to lag behind the line voltage. Upon activation, a capacitor bank pushes the line current back into phase with the line voltage, thereby boosting the power factor (i.e., the amount of power being delivered to the load). Capacitor switches generally perform only one open operation or one close operation at a time.

All switchgears include contacts, which come into proximity with one another during a closing operation and out of proximity with one another during an opening operation. Typically, one contact is stationary and one contact is movable. The movable contact moves towards the stationary contact during the closing operation and away from the stationary contact during the opening operation.

Generally, switchgears incorporate spring loaded mechanisms connected to an operating member to positively open or close the contacts. One such device that is commonly used is a simple toggle linkage. The primary function of these mechanisms is to minimize arcing between the contacts by very rapidly driving the contacts into their open or closed positions. Various applications may require the use of a number of spring loaded mechanisms with associated latches and linkages.

To prime these mechanical systems, either by compression or extension of the drive spring, an actuator is normally provided. For example, an actuator can be a solenoid, motor, hydraulic device, or voice coil. A voice coil actuator is a fast, powerful, and precise means for moving a load, such as a movable contact of a switchgear. The voice coil actuator uses a magnetic field and a coil winding to produce a force for driving the movable contact of the switchgear.

The major disadvantage of a voice coil actuator is that the voice coil has no inherent stable position when it is not powered. To overcome this, various mechanical means, such as over-toggle latches, have traditionally been used to keep the voice coil, and thus the switchgear contacts, in a stable position. These mechanical means have many disadvantages, including requiring extra energy to release the latch and being needlessly complex by requiring multiple movable parts.

Therefore, a need exists in the art for a simpler method and device for latching and releasing a voice coil actuator. A further need exists in the art for such a method and device to be energy-efficient.

SUMMARY OF THE INVENTION

The invention provides a simple and energy-efficient method and device for latching and releasing a voice coil actuator. Specifically, the invention provides a method and device for magnetically latching and releasing a voice coil actuator for controlling electrical switchgear. A magnetic field of a voice coil magnet latches and releases the voice coil actuator without any moving parts or extra energy.

A switchgear, such as a fault interrupter, a recloser, a breaker, or a capacitor switch, may include a voice coil actuator. The voice coil actuator is configured to open and close electrical contacts of a current interrupter of the switchgear. The voice coil actuator includes a voice coil magnet and a voice coil assembly disposed on a common longitudinal axis relative to the voice coil magnet.

The voice coil assembly includes a voice coil base and a voice coil hub. The voice coil base includes a substantially hollow, tubular member. The voice coil hub includes a cylindrical portion disposed within an interior cavity of the voice coil base and an elongated, protruding portion that extends from the cylindrical portion. The protruding portion extends along the common longitudinal axis, in a direction away from the voice coil magnet.

At least one pair of metallic latching members is mounted to the voice coil assembly. A first member of each pair is mounted to an outer periphery of the voice coil assembly. A second member of each pair is mounted within the interior cavity of the voice coil base, abutting an interior face of the voice coil base and a surface of the voice coil hub. For example, the first member and the second member can be connected to one another and/or the voice coil assembly via one or more connecting pins or other suitable attachment means.

A coil is wound about an outer diameter of at least a portion of the voice coil base. Running electrical current through the coil creates a magnetic field around the voice coil assembly. Creation of this magnetic field causes a force to be exerted on the voice coil assembly. Depending on the direction of the current flow through the coil, the force on the voice coil assembly is either an attractive force, in a direction towards of the voice coil magnet, or a repelling force, in a direction away from the voice coil magnet.

An opening spring and a contact pressure spring are coupled to the voice coil assembly, along the common longitudinal axis. The opening spring is configured to exert a force on the voice coil assembly, in a direction away from the voice coil magnet. The contact pressure spring is configured to exert a force on the voice coil assembly, in an opposite direction of the force of the opening spring. For example, movement of the voice coil assembly away from the voice coil magnet can cause the electrical contacts of the current interrupter to separate, thereby opening an AC circuit comprising the electrical contacts. Similarly, movement of the voice coil assembly towards the voice coil magnet can cause the electrical contacts of the current interrupter to come together, thereby closing the AC circuit comprising the electrical contacts.

The net of the forces exerted on the voice coil assembly by the magnetic field of the voice coil assembly, the opening spring, and the contact pressure spring moves the voice coil assembly along the common longitudinal axis. When the net force moves the voice coil assembly towards the voice coil magnet, the voice coil assembly engages the voice coil magnet. At least a portion of the coil of the voice coil assembly slide into a corresponding groove of the voice coil magnet.

The second member of each pair of latching members engages a surface of the voice coil magnet. In this position, the latching members will create a low reluctance path for a magnetic field of the voice coil magnet. The magnetic field travels from the voice coil magnet, through the latching members, and back into the voice coil magnet. This path causes a strong attractive, latching force between the voice coil magnet and the voice coil assembly, with the second members being held tightly to the surface of the voice coil magnet. The latching force is essentially a permanent magnet circuit between the latching members and the voice coil magnet. Accordingly, the position of the voice coil assembly relative to the voice coil magnet remains intact, even when power to the coil is removed.

To release the latch (i.e., the permanent magnet), current is transmitted through the coil, in a direction that counters the magnetic field of the voice coil magnet. This current creates a (Lorentz) force on the voice coil assembly, in a direction away from the voice coil magnet. The countering magnetic field from the current also redirects the flux from the pair of latching members away from the voice coil magnet, significantly reducing the magnetic latching force between the voice coil assembly and the voice coil magnet. The Lorentz force and the weakened latching force cause the net force on the voice coil assembly, i.e., the sum of the Lorentz force, the weakened latching force, the force of the contact pressure spring, and the force of the opening spring, to move the voice coil assembly away from the voice coil magnet.

In certain exemplary embodiments, the latch can be released manually by applying a force to one or more members coupled to the voice coil assembly. The member(s) can transfer the force to the voice coil assembly, thereby disengaging the voice coil assembly from the voice coil magnet. Once the latch has been released, the force from the opening spring will hold the voice coil assembly stable until current is passed through the coil in another direction.

In certain exemplary embodiments, the voice coil actuator can further include a stopping member configured to prevent the voice coil assembly from traveling more than a predetermined distance from the voice coil magnet during the latch release. For example, the stopping member can include a substantially cylindrical member disposed between the voice coil magnet and the opening spring, along the common longitudinal axis.

These and other aspects, features and embodiments of the invention will become apparent to a person of ordinary skill in the art upon consideration of the following detailed description of illustrated embodiments exemplifying the best mode for carrying out the invention as presently perceived.

DETAILED DESCRIPTION OF EXEMPLARY EMBODIMENTS

The following description of exemplary embodiments refers to the attached drawings, in which like numerals indicate like elements throughout the several figures.

Figure 1:
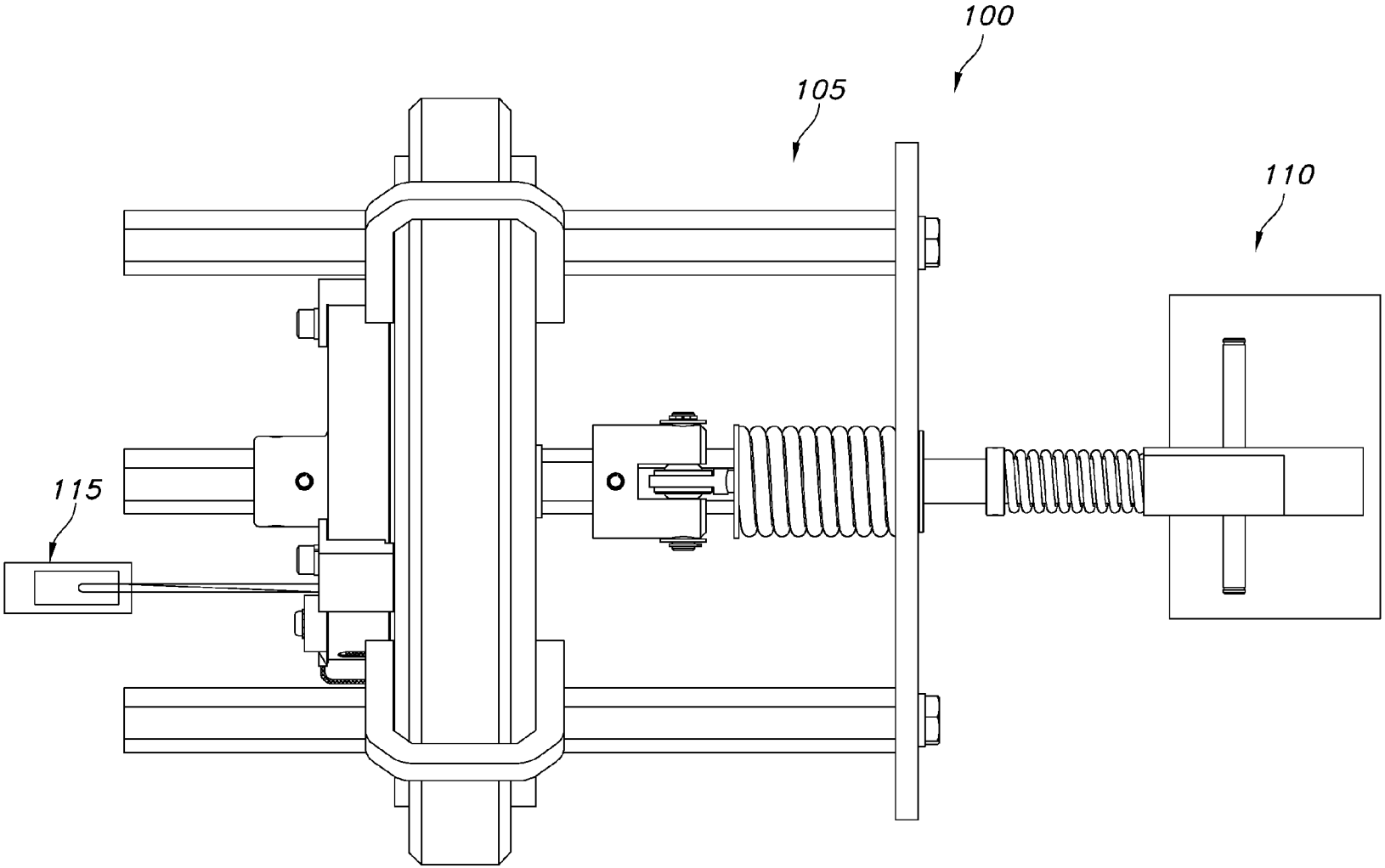
FIG. 1 is a cross-sectional side view of a switchgear in a closed position, in accordance with certain exemplary embodiments.

FIG. 1 is a cross-sectional side view of a switchgear 100 in a closed position, in accordance with certain exemplary embodiments. The switchgear 100 includes a voice coil actuator 105 configured to open and close electrical contacts (771 and 772 in FIG. 7) of a current interrupter 110. A motion circuit 115 of the switchgear is configured to supply power to the voice coil actuator 105, as described below. For example, the switchgear 100 can be a fault interrupter, a recloser, a breaker, or a capacitor switch. The current interrupter 110 is described in more detail below, with reference to FIG. 7.

Figure 6:
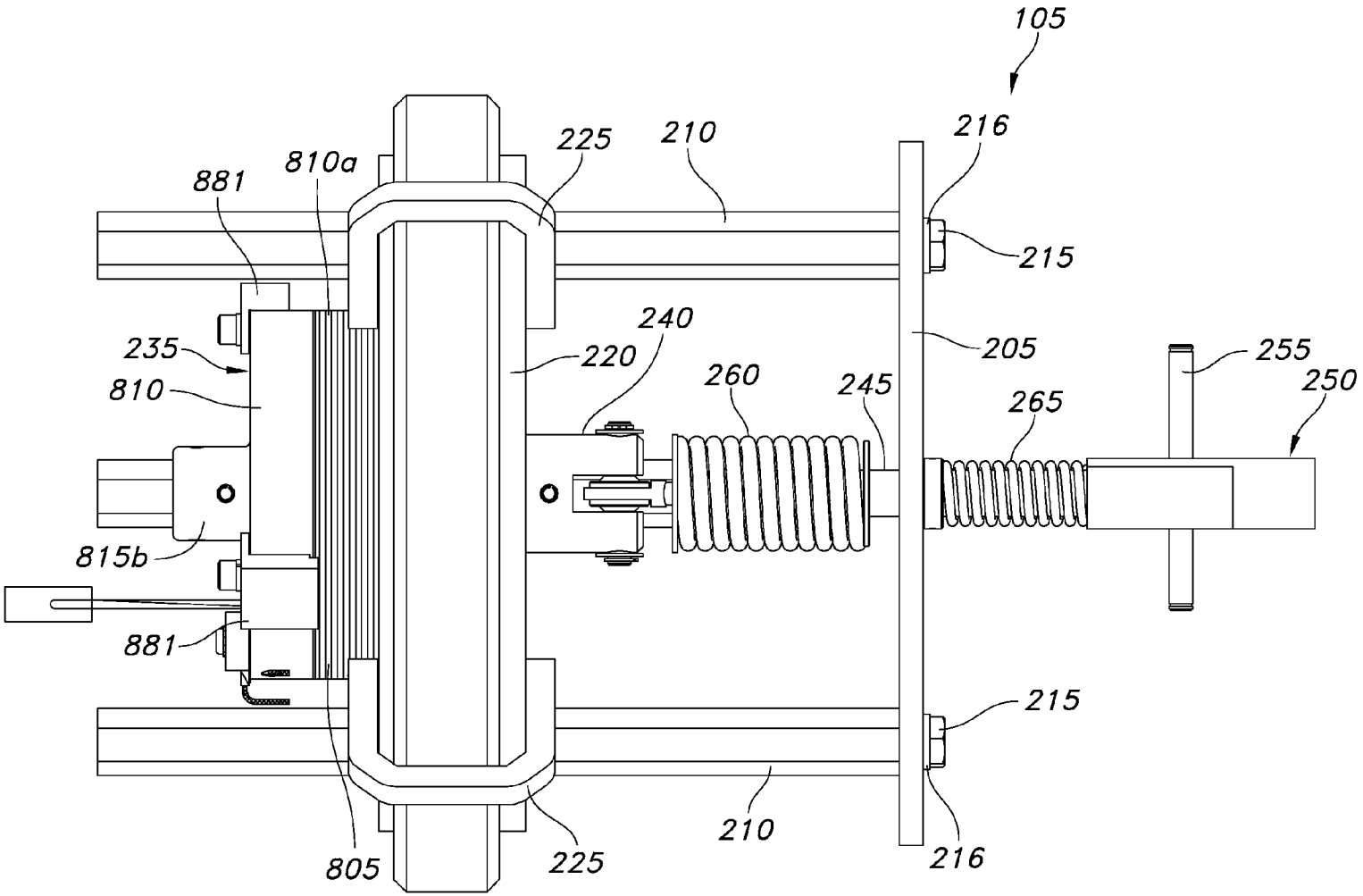
FIG. 6 is a cross-sectional side view of a voice coil actuator of a switchgear in an open position, in accordance with certain exemplary embodiments.

FIGS. 2-6 are cross-sectional side views of the voice coil actuator 105. FIGS. 2-5 illustrate the voice coil actuator 105 in a closed position. FIG. 6 illustrates the voice coil actuator 105 in an open position.

As illustrated in FIGS. 2-6, the voice coil actuator 105 includes a top plate 205 coupled to three elongated spacing members 210 via hex bolts 215 and washers 216. A voice coil magnet 220 is attached to each of the elongated spacing members 210. For example, one or more threaded rods 305 (FIG. 3) can attach the elongated spacing members 210 to the voice coil magnet 220. A series of substantially "U"-shaped spacing members 225 are disposed about a circumferential edge **220*a* of the voice coil magnet 220. The elongated spacing members 210 and the substantially "U"-shaped spacing members 225 are configured to align the voice coil actuator 105 within a housing (not shown) of the switchgear 100. For example, the substantially "U"-shaped spacing members 225** can comprise a foam material.

A person of ordinary skill in the art, having the benefit of the present disclosure, will recognize that many other means exist for aligning the voice coil actuator 105 within the housing of the switchgear 100. For example, many other suitable numbers and types of spacing members can be used to align the voice coil actuator 105 within the housing of the switchgear 100.

An inner circumferential edge of the voice coil magnet 220 is disposed about an elongated voice coil operating rod 230. The operating rod 230 is disposed substantially parallel to an axis of the elongated spacing members 210. The operating rod 230 slidably extends through the voice coil magnet 220 and is fixedly coupled to a voice coil assembly 235. The voice coil assembly 235 is disposed on a common longitudinal axis with respect to the voice coil magnet 220. The voice coil assembly 235 is configured to exert a force on the operating rod 230 for moving the operating rod 230 along its axis. The voice coil assembly 235 is described in more detail below, with reference to FIG. 8.

Figure 7:
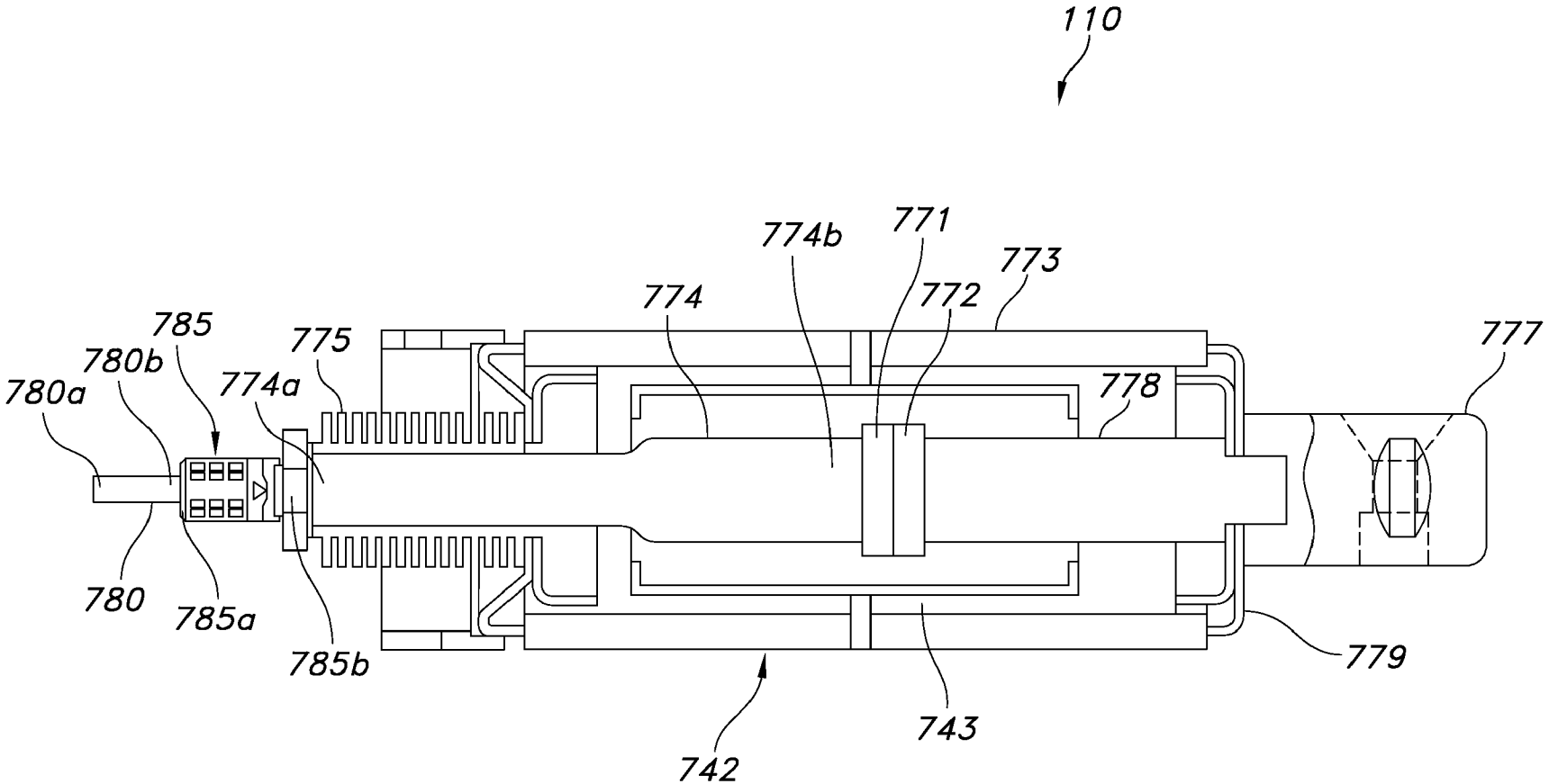
FIG. 7 is a cross-sectional side view of a current interrupter of a switchgear in a closed position, in accordance with certain exemplary embodiments.

FIG. 7 is a cross-sectional side view of the current interrupter 110 in a closed position, in accordance with certain exemplary embodiments. With reference to FIGS. 2-5 and 7, movement of the operating rod 230 causes the electrical contacts 771 and 772 of the current interrupter 110 to either come together (in a closing operation) or pull apart (in an opening operation). The operating rod 230 is coupled to the electrical contact 771 via a stopping member 240 an opening spring 260, an interrupter operating rod 245, a contact pressure spring 265, an engaging coupler 250, a coupling rod 780, a sliding current interchange 785, and a movable conducting rod 774. The operating rod 230, stopping member 240, opening spring 260, interrupter operating rod 245, contact pressure spring 265, engaging coupler 250, coupling rod 780, sliding current interchange 785, movable conducting rod 774, and electrical contact 771 are disposed on a common longitudinal axis.

An end 230*a* of the operating rod 230, opposite the voice coil magnet 220, is attached to a first end 240*a* of the stopping member 240 via one or more connecting pins 240*c* or other suitable attachment means. The stopping member 240 is a substantially cylindrical member configured to prevent the voice coil assembly 235 from traveling more than a predetermined distance from the voice coil magnet 220 during an opening operation, as described in more detail below. A second end 240*b* of the stopping member 240 is attached to a first end 245*a* of the interrupter operating rod 245 via one or more connecting pins 240*d* or other suitable attachment means.

The contact pressure spring 265 and opening spring 260 are disposed about the interrupter operating rod 245, on opposite sides of the top plate 205. The contact pressure spring 265 is configured to exert a force on the interrupter operating rod 245 (and other system components fixedly coupled thereto, including the operating rod 230 and the voice coil assembly 235), in the direction of the contact 772. The opening spring 260 is configured to exert a force on the interrupter operating rod 245 (and other system components fixedly coupled thereto, including the operating rod 230 and the voice coil assembly 235) in the opposite direction, away from the contact 772. Operation of the contact pressure spring 265 and the opening spring 260 is described in more detail below.

A second end 245*b* of the interrupter operating rod 245 is attached to a first end 250*a* of the engaging coupler 250. The engaging coupler 250 includes a member 255 for manually releasing a latch between the voice coil assembly 235 and the voice coil magnet 220, as described below. A second end 250*b* of the engaging coupler 250 attaches to a first end 780*a* of the coupling rod 780 via one or more connecting pins 250*c* or other suitable attachment means. For example, the coupling rod 780 can comprise an insulating material, such as fiberglass.

A second end 780*b* of the coupling rod 780 is attached to a first end 785*a* of the sliding current interchange 785. A second end 785*b* of the sliding current interchange 785 is attached to a first end 774*a* of the movable conducting rod 774. A second end 774*b* of the movable conducting rod 774 is affixed to the contact 771.

A flexible bellows 775 disposed about a portion of the movable conducting rod 774, proximate to the sliding current interchange 785, allows the conducting rod 774, and thus the electrical contact 771, to move axially as a function of the movement of the operating rod 230. In contrast, the electrical contact 772 is substantially stationary. The electrical contact 772 is coupled to a stationary conductor rod 778 that attaches to a source side terminal 777 via an end cap 779. For simplicity, the electrical contact 771 is referred to herein as the "movable contact" 771, and the electrical contact 772 is referred to herein as the "stationary contact" 772.

When the contacts 771 and 772 come together during a closing operation, an AC circuit is made through the contacts 771 and 772, from the fixed contact 772 or source side terminal 777 to the movable contact 771 or a load side terminal (not shown) that makes contact with the sliding current interchange 785, and allows the current to flow through the contacts 771 and 772 of the current interrupter 110. The contacts 771 and 772 separate during an opening operation to open the AC circuit and stop current flow.

A vacuum bottle 742 of the current interrupter 110 contains the contacts 771 and 772 in an evacuated environment. Specifically, air is removed from the vacuum bottle 742, leaving a deep vacuum 743 having a high voltage withstand and desirable current interruption abilities. The vacuum bottle 742 includes an insulated casing 773 comprising a ceramic material and having a generally cylindrical shape. For example, the ceramic material can comprise alumina. The bellows 775 of the current interrupter 110 includes a convoluted flexible material configured to maintain the integrity of the vacuum during a movement of the movable contact 771 toward or away from the stationary contact 772.

A person of ordinary skill in the art, having the benefit of the present disclosure, will recognize that the switchgear 100 can use other, non-vacuum interrupters, without departing from the sprit and scope of the invention. For example, an interrupter containing a dielectric medium, such as SF6, oil, or air, can be employed in certain alternative exemplary embodiments.

Figure 2:
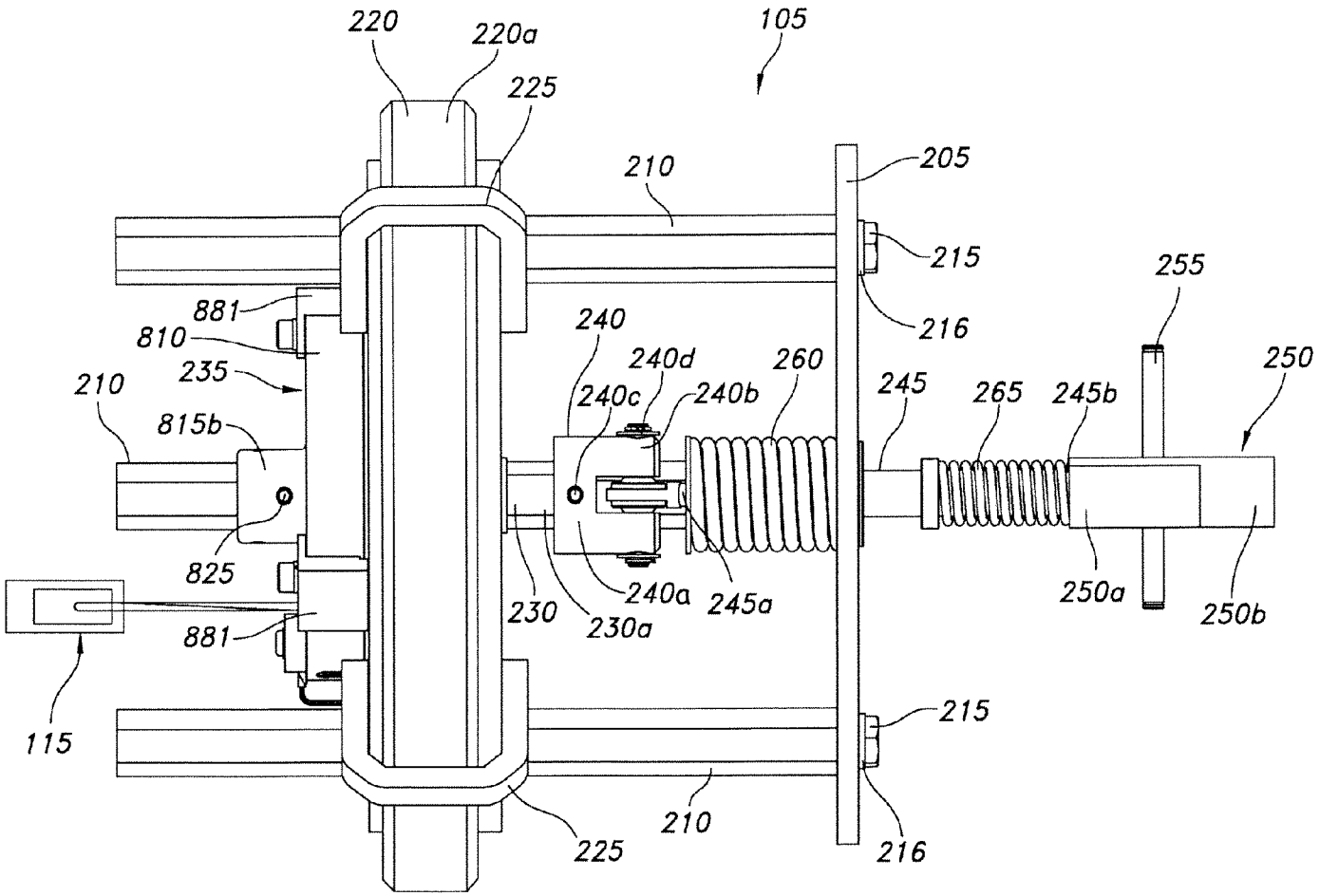
FIG. 2 is a cross-sectional side view of a voice coil actuator of a switchgear in a closed position, in accordance with certain exemplary embodiments.
Figure 3:
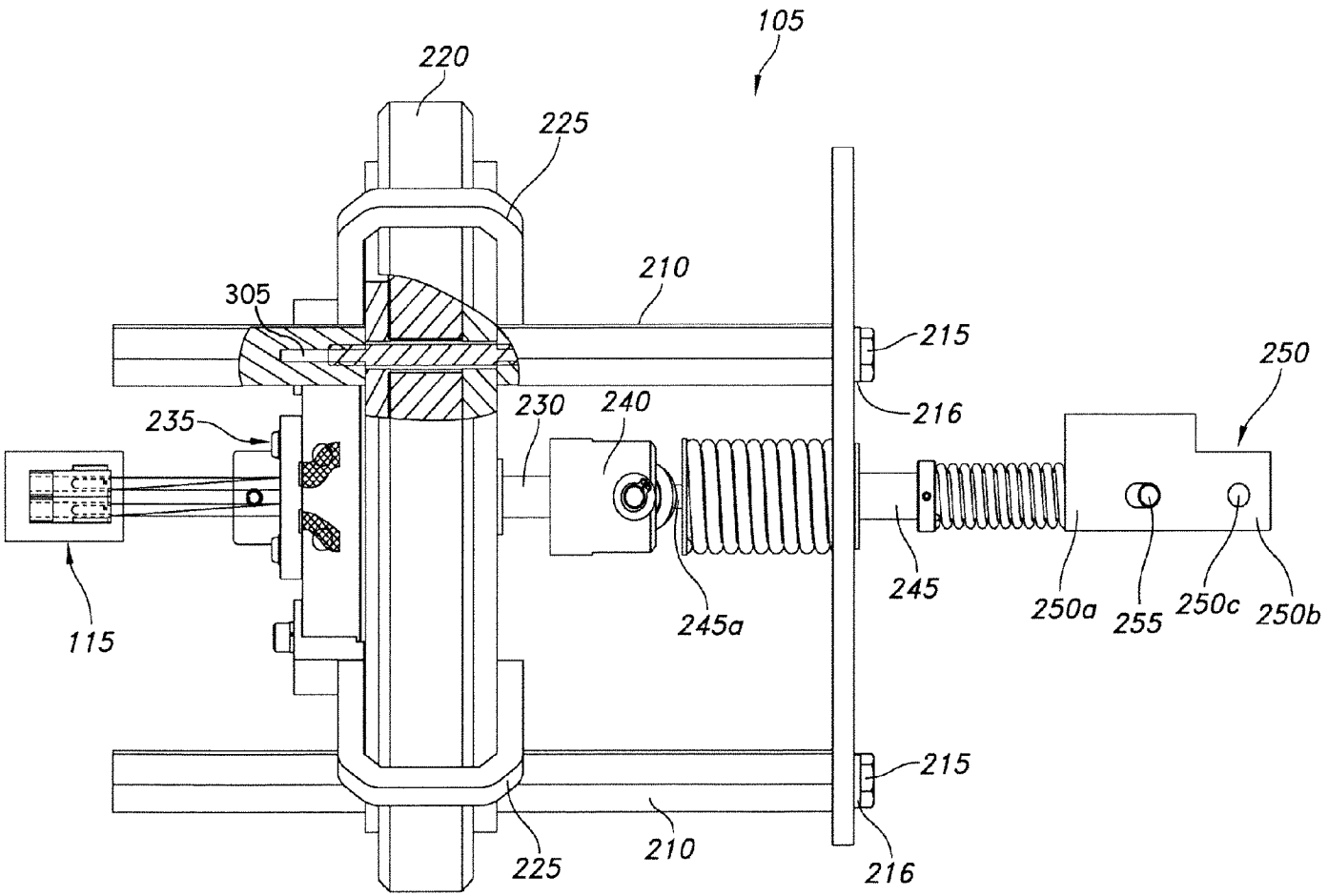
FIGS. 3-5 are other cross-sectional side views of the exemplary voice coil actuator of FIG. 2.
Figure 4:
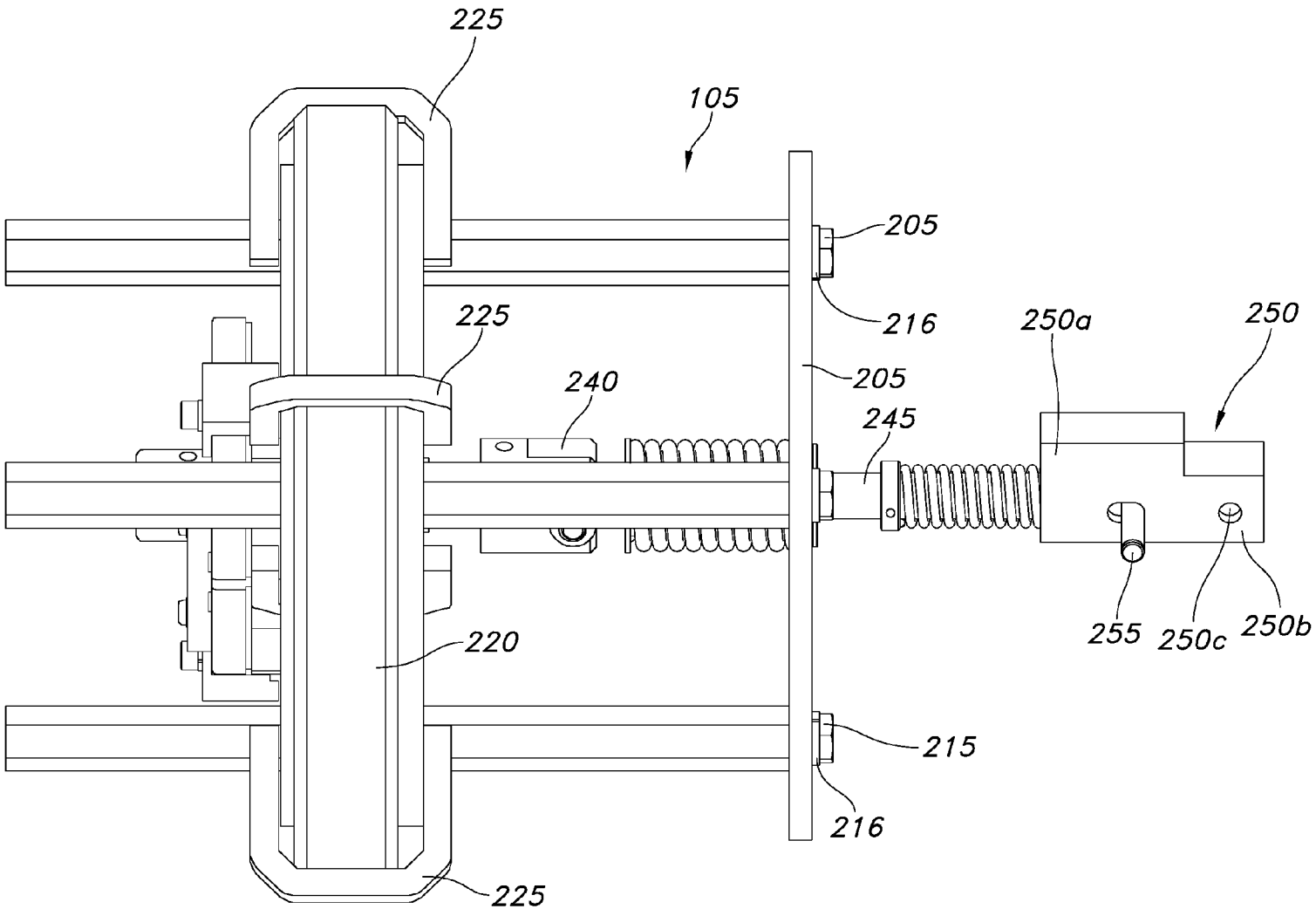
Figure 5:
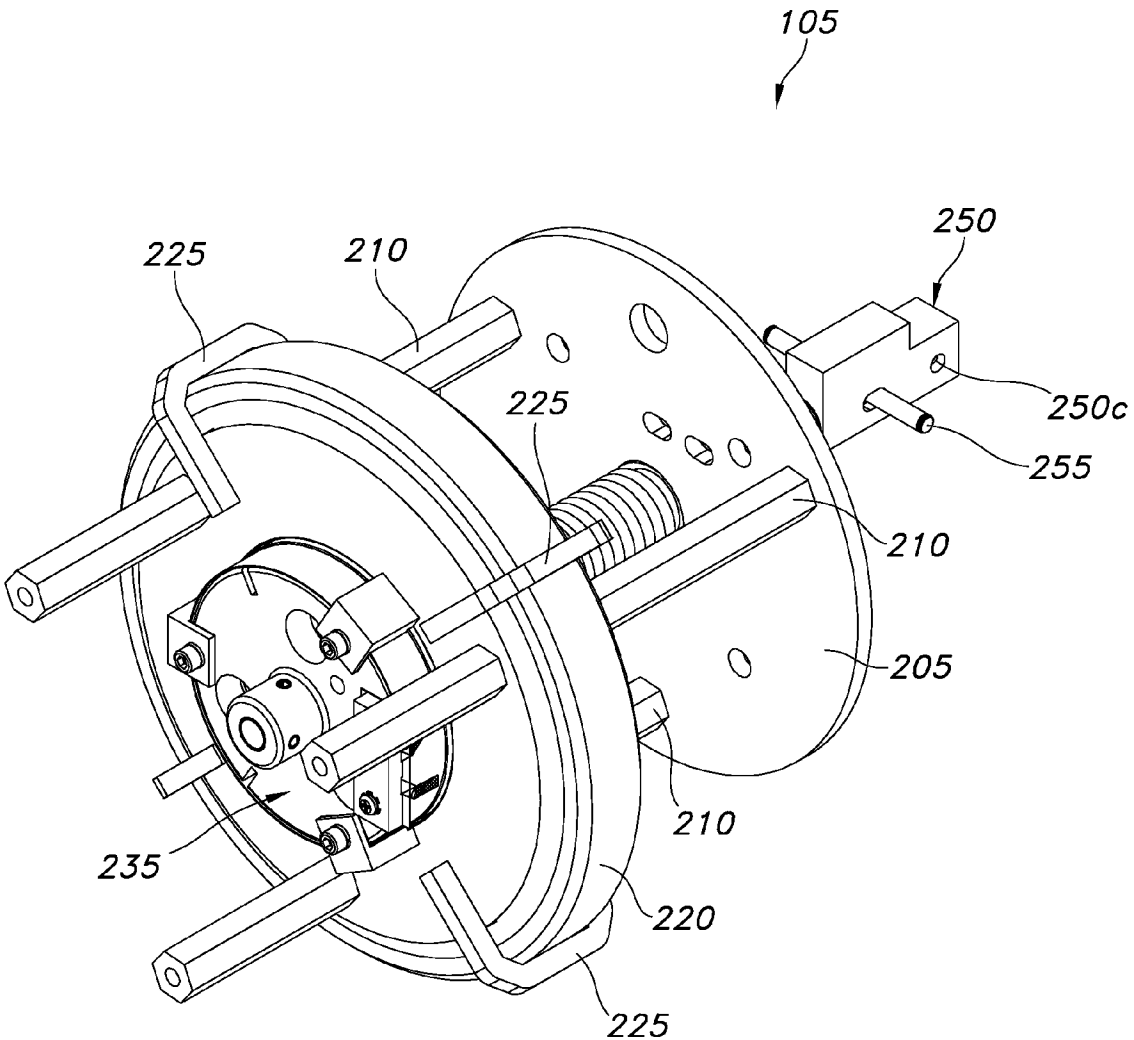
Figure 8:
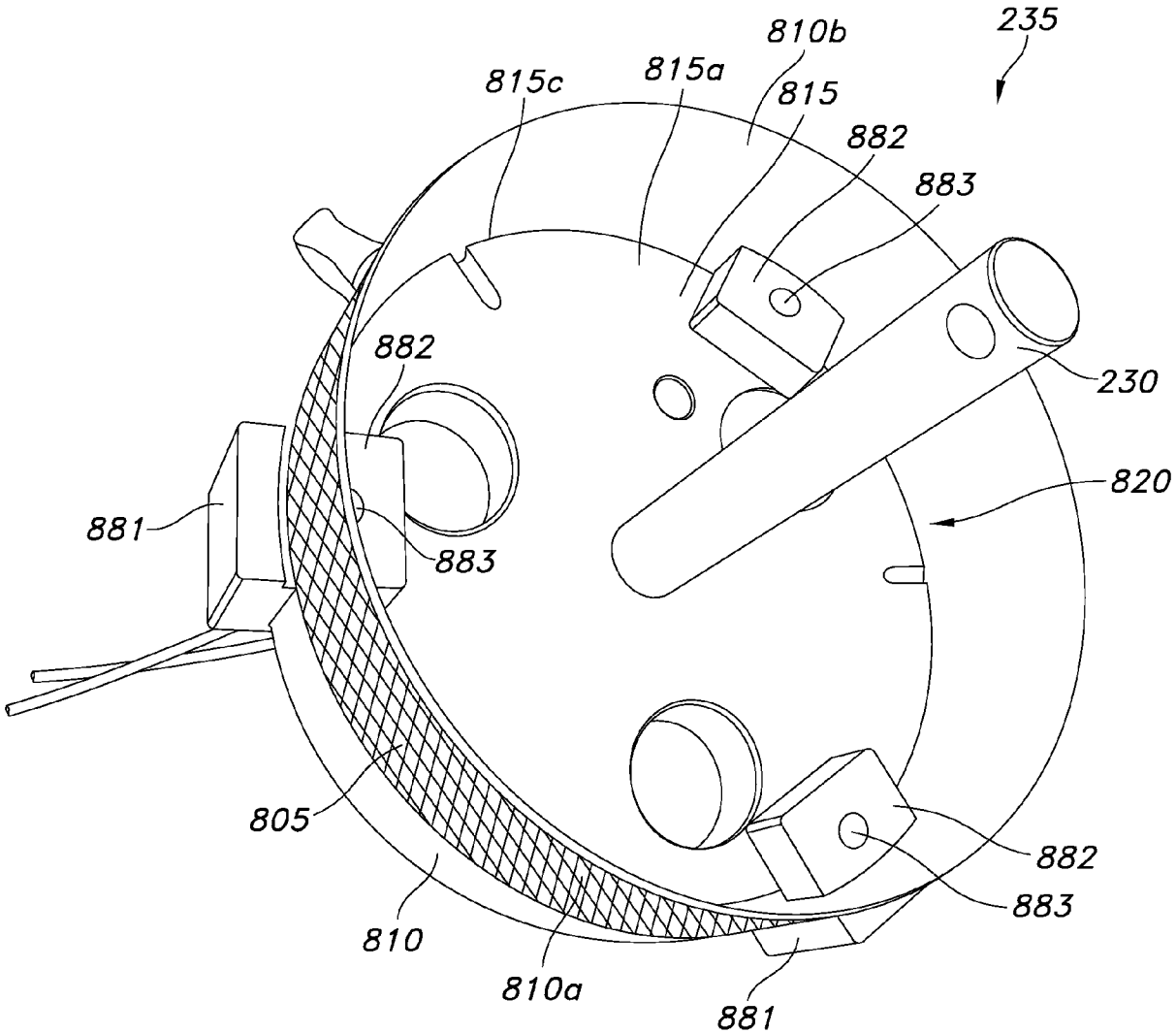
FIG. 8 is a perspective view of a voice coil assembly of a switchgear, in accordance with certain exemplary embodiments.

FIG. 8 is a perspective view of the voice coil assembly 235, in accordance with certain exemplary embodiments. With reference to FIGS. 2 and 8, the voice coil assembly 235 includes a coil 805 disposed about an outer diameter of a portion 810*a* of a voice coil base 810. The voice coil base 810 includes a substantially hollow, tubular member. For example, the voice coil base 810 can comprise a light-weight, fiberglass material. The voice coil base 810 is adhesively bonded or otherwise affixed to a voice coil hub 815 of the voice coil assembly 235.

The voice coil hub 815 is disposed about the operating rod 230 and includes a cylindrical portion 815*a* having a diameter slightly less than the diameter of the voice coil base 810 and an elongated, protruding portion 815*b* having a diameter larger than a diameter of the operating rod 230. The cylindrical portion 815*a* of the voice coil hub 815 is disposed within an interior cavity 820 of the voice coil assembly 235. The protruding portion 815*b* extends from the cylindrical portion 815*a*, in an axial direction away from the voice coil magnet 220. For example, the voice coil hub 815 can include one or more pieces of non-magnetic material, such as aluminum. The voice coil hub 815 is attached to the operating rod 230 via one or more connecting pins 825. In certain alternative embodiments, other means, such as straps, brackets, braces, hooks, clips, rings, loop fasteners, ties, screws, nails, concrete, adhesive glue or tape, or welding, can be used to attach the voice coil hub 815 to the operating rod 230.

With reference to FIG. 1, a power supply of the motion circuit 115 of the switchgear 100 is configured to supply power to the voice coil assembly 235. Specifically, the power supply is configured to transmit electrical current through the coil 805 of the voice coil assembly 235. Running electrical current through the coil 805 creates a magnetic field around the voice coil assembly 235. Creation of this magnetic field exerts a force on the voice coil assembly 235. Depending on the direction of the current flow through the coil 805, the force on the voice coil assembly 235 is either an attractive force, in a direction towards of the voice coil magnet 220, or a repelling force, in a direction away from the voice coil magnet 220.

The voice coil hub 815 transfers the force from the voice coil assembly 235 to the operating rod 230. The force on the operating rod 230 is proportional to the current flowing through the coil 805 and causes the operating rod 230 to move along its axis.

Figure 9:
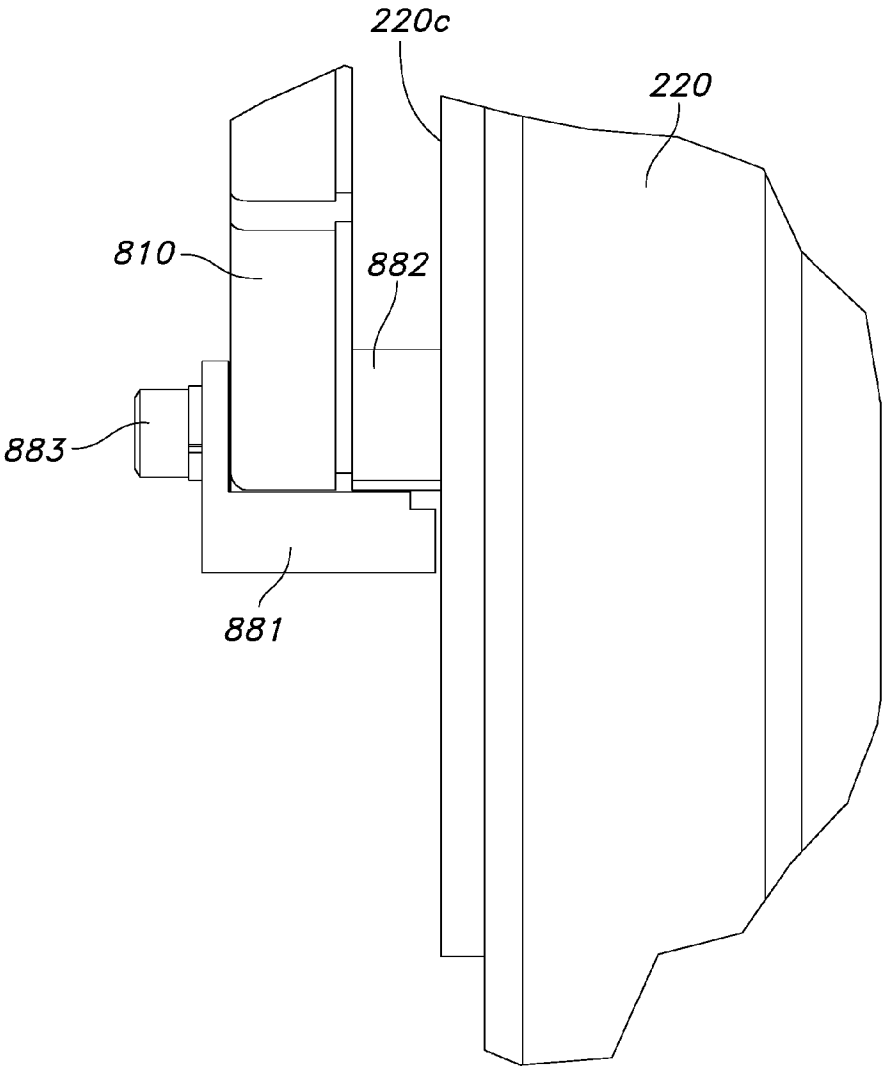
FIG. 9 is a cross-sectional side view of a voice coil hub, latching members, and a voice coil magnet of a latched voice coil actuator, in accordance with certain exemplary embodiments.

FIG. 9 is a cross-sectional side view of the voice coil hub 810, latching members 881 and 882, and the voice coil magnet 220 of a latched voice coil actuator 105, in accordance with certain exemplary embodiments. With reference to FIGS. 2, 8, and 9, three substantially "L"-shaped members 881 are mounted to an outer periphery of the voice coil assembly 235, and three substantially rectangular latching members 882 are mounted within the interior cavity 820 of the voice coil assembly 235.

The latching members 882 are mounted proximate a circumferential edge 815*c* of the voice coil hub 815 and an interior face 810*b* of the voice coil base 810. The latching members 882 are equally spaced about the operating rod 230, which extends through the interior cavity 820 of the voice coil assembly 235. The L-shaped members 881 are equally spaced about the outer periphery of the voice coil assembly 235. Each of the L-shaped members 881 and the latching members 882 includes one or more pieces of a magnetic-grade, metallic material, such as low carbon steel 12L14.

In certain exemplary embodiments, each L-shaped member 881 can be attached to a corresponding latching member 882. For example, a threaded rod 883 or other suitable attachment means can secure the corresponding latching members 882 and L-shaped members 881 (as best seen in FIG. 9). The latching members 882 and L-shaped members 881 are configured to latch and release the voice coil actuator 105, as described below.

Operation of the switchgear 100 will now be described with reference to FIGS. 1, 2, 6, and 7. FIGS. 1 and 2 illustrate the actuator assembly 105 in a closed position. FIG. 6 illustrates the actuator assembly 105 in an open position. To go from the open position to the closed position, a force is applied to the operating rod 230 (and other system components fixedly coupled thereto, including the interrupter operating rod 245, the coupling rod 780, and the voice coil assembly 235), in the direction of the electrical contact 772. This force is a net force, comprising the sum of a force caused by electric current flowing through the coils 805 of the voice coil assembly 235, a force from the opening spring 260, and a force from the contact pressure spring 265. To go from the open position to the closed position, the net of these forces must be a force in the direction of the contact 772.

When the net force applied to the operating rod 230 is in the direction of the contact 772, the operating rod 230 and the other system components fixedly coupled thereto, including the voice coil assembly 235, the interrupter operating rod 245, the coupling rod 780, and the movable contact 771, move towards the contact 772, in an axial direction. This movement causes the contacts 771 and 772 to come together, thereby closing the AC circuit with the contacts 771 and 772.

In the closed position, the voice coil assembly 235 abuts the voice coil magnet 220, with the coil 805 being disposed within a groove (not shown) of the voice coil magnet 220. As can best be seen in FIG. 9, the rectangular latching members 882 of the voice coil assembly 235 engage a first face 220*c* of the voice coil magnet 220. The latching members 882 and the L-shaped members 881 of the voice coil assembly 235 create a low reluctance path for the magnetic field of the voice coil magnet 220. The magnetic field travels from the voice coil magnet 220, through the L-shaped members 881, the latching members 882, and back into the magnet 220. This path causes a strong attractive, latching force between the voice coil magnet 220 and the voice coil assembly 235, with the latching members 882 being magnetically held tightly to the voice coil magnet 220. This latching force maintains the position of the voice coil assembly 235 relative to the voice coil magnet 220, thereby causing the contacts 771 and 772 to be securely held in a closed position.

The latching force is a result of a permanent magnet circuit between the members 881 and 882 and the voice coil magnet 220. Accordingly, the position of the voice coil assembly 235 relative to the voice coil magnet 220 (and the position of the movable contact 771 relative to the stationary contact 772) remains intact, even when power to the coil 805 is removed.

A person of ordinary skill in the art, having the benefit of the present disclosure, will recognize that, although the exemplary embodiment illustrated in the figures depicts three sets of L-shaped members 881 and rectangular shaped members 882, other suitable numbers and shapes of latching members can be used. For example, a single L-shaped member 881 can be disposed around the entire circumference of the voice coil assembly 235. The total circumferential length of the L-shaped member(s) 881 (and the members 882) is directly proportional to the magnetic latching force between the voice coil magnet 220 and the voice coil assembly 235.

To release the latch, and thereby open the contacts 771 and 772, the motion circuit 115 causes current to pass through the coil 805, in a direction that counters the magnetic field of the voice coil magnet 220. For example, the current can be the reverse of the current applied to the coil 805 in the closing operation. The current creates a force on the voice coil assembly 235, in a direction away from the voice coil magnet 220, i.e., a Lorentz force. The countering magnetic field from the current also redirects the flux from the members 881 and 882 away from the voice coil magnet 220, significantly reducing the magnetic latching force between the voice coil assembly 235 and the voice coil magnet 220.

The Lorentz force and the weakened latching force cause the net force on the operating rod 230 (and the system components fixedly coupled thereto, including the voice coil assembly 235, the interrupter operating rod 245, the coupling rod 780, and the movable contact 771) to be a force in a direction away from the contact 772. The net force is the sum of the Lorentz force, the weakened latching force, the force of the opening spring 235, and the force of the contact pressure spring 240. The net force causes the operating rod 230 and the system components fixedly coupled thereto, including the voice coil assembly 235, the interrupter operating rod 245, the coupling rod 780, and the movable contact 771, to move away from the contact 772. This movement causes the contacts 771 and 772 to separate, thereby opening the AC circuit with the contacts 771 and 772.

In certain exemplary embodiments, the latch can be released manually by applying a force to the member 255 of the engaging coupler 250. The member 250 can transfer the force to the voice coil assembly 235 (via the operating rod 235 and the interrupter operating rod 245), thereby disengaging the voice coil assembly 235 from the voice coil magnet 220.

The stopping member 240 prevents the voice coil assembly 235 from traveling more than a predetermined distance from the voice coil magnet 220 during the opening operation. The first end 240*a* of the stopping member 240 abuts a second face 220*d* of the voice coil magnet 220 once the voice coil assembly 235 has traveled that predetermined distance. Once fully open, the force from the opening spring 240 holds the voice coil assembly 235 stable until current is passed through the coil 805 in another direction. For example, a reverse current can cause a closing operation, as described above.

In certain exemplary embodiments, the motion control circuit 115 is configured to synchronize the initiation of the switchgear 100 operation so that the actual closing or opening of the contacts 771 and 772 occurs when the AC voltage or current across the contacts 771 and 772 is at zero volts or zero amperes, respectively. Such synchronization minimizes arcing between the contacts 771 and 772 during the opening and closing operations, thereby preventing excessive electrical stress on, and damage to, the electrical contacts 771 and 772 and other system components. The motion control circuit 115 also can be coupled to a position feedback device (not shown) configured to provide the motion control circuit 115 with real-time contact position feedback information during each switching operation. Certain features of an exemplary motion control circuit 115 are described in U.S. Pat. No. 6,921,989, entitled "Electrical Switchgear with Synchronous Control System and Actuator," the disclosure of which is hereby fully incorporated herein by reference In conclusion, the foregoing exemplary embodiments enable a magnetic latch for a voice coil actuator. Many other modifications, features, and embodiments will become evident to a person of ordinary skill in the art having the benefit of the present disclosure. It should be appreciated, therefore, that many aspects of the invention were described above by way of example only and are not intended as required or essential elements of the invention unless explicitly stated otherwise. It should also be understood that the invention is not restricted to the illustrated embodiments and that various modifications can be made within the spirit and scope of the following claims.

We claim:

1. A voice coil actuator, comprising:

a voice coil magnet; and a voice coil assembly comprising a tubular member comprising outer periphery and an interior surface that defines an interior cavity, and at least one pair of metallic members coupled to the tubular member, a first metallic member of each pair being disposed within the interior cavity of the tubular member and coupled to the interior surface of the tubular member, a second metallic member of each pair being coupled to the outer periphery of the tubular member and defining at least a portion of an outer periphery of the voice coil assembly, wherein at least one of the voice coil magnet and the voice coil assembly is positionable relative to the other of the voice coil magnet and the voice coil assembly between a connected position and a disconnected position, and wherein, when the voice coil assembly and voice coil magnet move from the disconnected position to the connected position, the metallic members complete a permanent magnet circuit with the voice coil magnet, the permanent magnet circuit latching the voice coil assembly and the voice coil magnet in the connected position.

2. The voice coil actuator of claim 1, wherein the voice coil assembly comprises multiple pairs of metallic members, the first metallic members of the pairs being substantially equally spaced about the outer periphery of the tubular member.

3. The voice coil actuator of claim 1, wherein the voice coil assembly comprises three pairs of metallic members.

4. The voice coil actuator of claim 1, wherein, for each pair of the metallic members, the first metallic member is coupled to the second metallic member.

5. The voice coil actuator of claim 1, further comprising a coil wound around at least a portion of the outer periphery of the tubular member, wherein, when the coil transmits electrical current in a first direction, the coil creates a magnetic field that causes the voice coil assembly and voice coil magnet to move relative to one another from the disconnected position to the connected position, and wherein, after the permanent magnet circuit latches the voice coil assembly relative to the voice coil magnet, the permanent magnet circuit continues to latch the voice coil assembly relative to the voice coil magnet regardless of whether the coil is still transmitting the electrical current.

6. The voice coil actuator of claim 5, wherein the permanent magnet circuit is released when the coil transmits electrical current in a second direction that is opposite the first direction.

7. The voice coil actuator of claim 6, wherein the voice coil assembly moves away from the voice coil magnet, to the disconnected position, when the permanent magnet circuit is released, and wherein the voice coil actuator further comprises a member coupled to the voice coil assembly, the member preventing the voice coil assembly from moving more than a predetermined distance from the voice coil magnet.

8. The voice coil actuator of claim 6, further comprising means for manually releasing the permanent magnet circuit latch.

9. The voice coil actuator of claim 1, further comprising a spring that exerts a force on the voice coil assembly, in a direction away from the voice coil magnet, the spring being disposed on a common longitudinal axis relative to the tubular member.

10. The voice coil actuator of claim 9, wherein the spring causes the tubular member to move away from the voice coil magnet, along the common longitudinal axis, when the permanent magnet circuit is released.

11. The voice coil actuator of claim 1, further comprising a spring that exerts a force on the voice coil assembly, in a direction towards the voice coil magnet, the spring being disposed on a common longitudinal axis relative to the tubular member.

12. The voice coil actuator of claim 1, wherein an AC circuit associated with the voice coil actuator is closed when the voice coil assembly and the voice coil magnet are in the connected position, and the AC circuit is open when the voice coil assembly and the voice coil magnet are in the disconnected position.

13. The voice coil actuator of claim 1, wherein the voice coil magnet comprises a groove in which at least a portion of the tubular member is disposed when the voice coil assembly and the voice coil magnet are in the connected position.

14. A voice coil actuator, comprising:

a voice coil assembly comprising:

a tubular member comprising an outer periphery and an interior surface that defines an interior cavity, at least one pair of metallic members coupled to the tubular member, a first metallic member of each pair being disposed within the interior cavity of the tubular member and coupled to the interior surface of the tubular member, a second metallic member of each pair being coupled to the outer periphery of the tubular member and defining at least a portion of an outer periphery of the voice coil assembly, and a coil wound around at least a portion of the outer periphery of the tubular member; and a voice coil magnet, wherein, when the coil transmits electrical current in a first direction, the coil creates a magnetic field that causes relative movement between the voice coil assembly and the voice coil magnet from a disconnected position to a connected position, the metallic members of the voice coil assembly completing a permanent magnet circuit with the voice coil magnet when the voice coil assembly and voice coil magnet are in the connected position, the permanent magnet circuit latching the voice coil assembly and the voice coil magnet in the connected position, and wherein, after the permanent magnet circuit latches the voice coil assembly and the voice coil magnet, the permanent magnet circuit continues to latch the voice coil assembly relative to the voice coil magnet regardless of whether the coil is still transmitting the electrical current.

15. The voice coil actuator of claim 14, wherein the voice coil assembly comprises multiple pairs of metallic members, the first metallic members of the pairs being substantially equally spaced about the outer periphery of the tubular member.

16. The voice coil actuator of claim 14, wherein the voice coil assembly comprises three pairs of metallic members.

17. The voice coil actuator of claim 14, wherein, for each pair of the metallic members, the first metallic member is coupled to the second metallic member.

18. The voice coil actuator of claim 14, wherein the permanent magnet circuit is released when the coil transmits electrical current in a second direction that is opposite the first direction.

19. The voice coil actuator of claim 18, wherein the voice coil assembly moves away from the voice coil magnet, to the disconnected position, when the permanent magnet circuit is released, and wherein the voice coil actuator further comprises a member coupled to the voice coil assembly, the member preventing the voice coil assembly from moving more than a predetermined distance from the voice coil magnet.

20. The voice coil actuator of claim 18, further comprising means for manually releasing the permanent magnet circuit latch.

21. The voice coil actuator of claim 14, further comprising a spring that exerts a force on the voice coil assembly, in a direction away from the voice coil magnet, the spring being disposed on a common longitudinal axis relative to the voice coil assembly.

22. The voice coil actuator of claim 21, wherein the spring causes the voice coil assembly to move away from the voice coil magnet, along the common longitudinal axis, when the permanent magnet circuit is released.

23. The voice coil actuator of claim 14, further comprising a spring that exerts a force on the voice coil assembly, in a direction towards the voice coil magnet, the spring being disposed on a common longitudinal axis relative to the tubular member.

24. The voice coil actuator of claim 14, wherein an AC circuit associated with the voice coil actuator is closed when the voice coil assembly and the voice coil magnet are in the connected position, and the AC circuit is open when the voice coil assembly and the voice coil magnet are in the disconnected position.

25. The voice coil actuator of claim 14, wherein the voice coil magnet comprises a groove in which at least a portion of the tubular member is disposed when the voice coil assembly and the voice coil magnet are in the connected position.

26. A switchgear, comprising:

a voice coil assembly comprising:

a tubular member comprising outer periphery and an interior surface that defines an interior cavity, and at least one pair of metallic members coupled to the tubular member, a first metallic member of each pair being disposed within the interior cavity of the tubular member and coupled to the interior surface of the tubular member, a second metallic member of each pair being coupled to the outer periphery of the tubular member and defining at least a portion of an outer periphery of the voice coil assembly;

a voice coil magnet disposed on a common longitudinal axis relative to the voice coil assembly, at least one of the voice coil assembly and the voice coil magnet being positionable relative to the other of the voice coil magnet and the voice coil assembly between a connected position and a disconnected position, and a current interrupter coupled to one of the voice coil assembly and the voice coil magnet, the current interrupter comprising a plurality of electrical contacts, at least one of the electrical contacts being positionable relative to at least one other of the electrical contacts to close and open an AC circuit associated with the current interrupter, movement of the voice coil assembly and voice coil magnet from the disconnected position to the connected position causing the electrical contacts to close the AC circuit, wherein, when the voice coil assembly and voice coil magnet move from the disconnected position to the connected position, the electrical contacts close the AC circuit, and the metallic members of the voice coil assembly complete a permanent magnet circuit with the voice coil magnet, the permanent magnet circuit latching the voice coil assembly relative to the voice coil magnet and the electrical contacts relative to one another to thereby securely hold the AC circuit in a closed position and the voice coil magnet and voice coil assembly in the connected position.

27. The switchgear of claim 26, wherein movement of the voice coil assembly and voice coil magnet from the connected position to the disconnected position causes the electrical contacts to open the AC circuit.

28. The switchgear of claim 26, wherein the voice coil assembly comprises multiple pairs of metallic members, the first metallic members of the pairs being substantially equally spaced about the outer periphery of the tubular member.

29. The switchgear of claim 26, wherein the voice coil assembly comprises three pairs of metallic members.

30. The switchgear of claim 26, wherein, for each pair of the metallic members, the first metallic member is coupled to the second metallic member.

31. The switchgear of claim 26, wherein the voice coil assembly further comprises a coil wound around at least a portion of the outer periphery of the tubular member, wherein, when the coil transmits electrical current in a first direction, the coil creates a magnetic field that causes the voice coil assembly and voice coil magnet to move relative to one another from the disconnected position to the connected position, and wherein, after the permanent magnet circuit latches the voice coil assembly relative to the voice coil magnet and the electrical contacts relative to one another, the permanent magnet circuit continues to latch the voice coil assembly relative to the voice coil magnet and the electrical contacts relative to one another regardless of whether the coil is still transmitting the electrical current.

32. The switchgear of claim 31, wherein the permanent magnet circuit is released when the coil transmits electrical current in a second direction that is opposite the first direction.

33. The switchgear of claim 32, wherein the voice coil assembly moves away from the voice coil magnet, to the disconnected position, when the permanent magnet circuit is released, and wherein the switchgear further comprises a member coupled to the voice coil assembly, the member preventing the voice coil assembly from moving more than a predetermined distance from the voice coil magnet.

34. The switchgear of claim 32, further comprising means for manually releasing the permanent magnet circuit latch.

35. The switchgear of claim 26, further comprising a spring that exerts a force on the voice coil assembly, in a direction away from the voice coil magnet, the spring being disposed on the common longitudinal axis.

36. The switchgear of claim 35, wherein the spring causes the voice coil assembly to move away from the voice coil magnet, along the common longitudinal axis, when the permanent magnet circuit is released.

37. The switchgear of claim 26, further comprising a spring that exerts a force on the voice coil assembly, in a direction towards the voice coil magnet, the spring being disposed on the common longitudinal axis.

38. The switchgear of claim 26, wherein the voice coil magnet comprises a groove in which at least a portion of the tubular member is disposed when the voice coil assembly and the voice coil magnet are in the connected position.

* * * * *